US008873793B2

(12) United States Patent
Jin et al.

(10) Patent No.: US 8,873,793 B2
(45) **Date of Patent: *Oct. 28, 2014**

(54) LOUDSPEAKER RESIN MOLDING COMPONENT AND LOUDSPEAKER USING THE SAME AND ELECTRONIC DEVICE AND MOBILE APPARATUS USING THE LOUDSPEAKER

(71) Applicant: Panasonic Corporation, Osaka (JP)

(72) Inventors: Yohei Jin, Mie (JP); Yoshimich Kajihara, Mie (JP); Toru Fujii, Shiga (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/946,799

(22) Filed: Jul. 19, 2013

(65) Prior Publication Data

US 2013/0301867 A1 Nov. 14, 2013

Related U.S. Application Data

(63) Continuation of application No. PCT/JP2012/002510, filed on Apr. 11, 2012.

(30) Foreign Application Priority Data

Apr. 15, 2011 (JP) ..... 2011-090773
Apr. 19, 2011 (JP) ..... 2011-092692
Apr. 19, 2011 (JP) ..... 2011-092693

(51) Int. Cl.

| | |
|---|---|
| ***H04R 1/00*** | (2006.01) |
| ***H04R 31/00*** | (2006.01) |
| ***H04R 9/02*** | (2006.01) |
| ***H04R 7/02*** | (2006.01) |
| *G10K 13/00* | (2006.01) |

(52) U.S. Cl.

CPC ..... *H04R 7/02* (2013.01); *H04R 31/003* (2013.01); *H04R 9/025* (2013.01); *H04R 2207/021* (2013.01); *H04R 2307/029* (2013.01)

USPC ..... 381/426; 381/428; 181/167; 181/169

(58) Field of Classification Search

USPC ..... 381/412, 426–428, 398, 421, 396; 181/167–170; 162/141–149; 423/447.1–447.9; 264/328.1; 524/13

See application file for complete search history.

(56) References Cited

U.S. PATENT DOCUMENTS 5,274,199 A * 12/1993 Uryu et al. ..... 181/169
7,296,691 B2 * 11/2007 Koslow ..... 210/501

(Continued)

FOREIGN PATENT DOCUMENTS

JP 59-176995 A 10/1984
JP 2005-075836 A 3/2005

(Continued)

OTHER PUBLICATIONS

Extended European Search Report issued in European Application No. 12771546.4 dated Oct. 25, 2013, 7 pages.

(Continued)

*Primary Examiner* — Curtis Kuntz
*Assistant Examiner* — Sunita Joshi
(74) *Attorney, Agent, or Firm* — McDermott Will & Emery LLP

(57) ABSTRACT

A loudspeaker resin molding component includes resin and bamboo fibers refined to have a microfibril status and carbonized. By this configuration, such a loudspeaker resin molding component can achieve both of a high elastic modulus and a large internal loss.

19 Claims, 5 Drawing Sheets

(56) References Cited

U.S. PATENT DOCUMENTS

| | | | | |
|---|---|---|---|---|
| 2007/0131478 | A1 * | 6/2007 | Okazaki et al. | 181/167 |
| 2010/0027826 | A1 | 2/2010 | Mimura et al. | |
| 2010/0059309 | A1 | 3/2010 | Kajihara et al. | |
| 2010/0172533 | A1 | 7/2010 | Kajihara et al. | |
| 2010/0296688 | A1 | 11/2010 | Funahashi | |
| 2011/0164764 | A1 | 7/2011 | Jin et al. | |

FOREIGN PATENT DOCUMENTS

| | | | |
|---|---|---|---|
| JP | 2005-236497 | A | 9/2005 |
| JP | 2007-235522 | A | 9/2007 |
| JP | 2009-171386 | A | 7/2009 |
| JP | 04-367198 | B2 | 11/2009 |
| WO | 2009090857 | A1 | 7/2009 |
| WO | WO 2009090857 | A1 * | 7/2009 |

OTHER PUBLICATIONS

International Search Report issued in PCT/JP2012/002510, dated Jul. 5, 2012.

* cited by examiner

LOUDSPEAKER RESIN MOLDING COMPONENT AND LOUDSPEAKER USING THE SAME AND ELECTRONIC DEVICE AND MOBILE APPARATUS USING THE LOUDSPEAKER

CROSS REFERENCE TO RELATED APPLICATIONS

This application is a Continuation of International Application No. PCT/JP2012/002510, filed Apr. 11, 2012, which claims priority of Japanese Patent Application No. 2011-090773, filed Apr. 15, 2011, Japanese Patent Application No. 2011-092692, filed Apr. 19, 2011, and Japanese Patent Application No. 2011-092693, filed Apr. 19, 2011, disclosures of which are hereby incorporated by reference.

BACKGROUND

1. Technical Field

The present technical field relates to a loudspeaker resin molding component used for various loudspeakers, a loudspeaker using the same, an electronic device such as a stereo set or a television set, and a mobile apparatus.

2. Background Art

A conventional loudspeaker resin molding component will be described.

A conventional loudspeaker resin molding component is formed by injection-molding resin such as polypropylene.

This resin material is generally a single material such as polypropylene. By adding reinforcement material such as fibers to this resin, characteristics required for a loudspeaker resin molding component are realized.

SUMMARY

A loudspeaker resin molding component according to various embodiments includes bamboo fibers refined to have a microfibril status and carbonized, and resin.

By the configuration as described above, a loudspeaker resin molding component can have both of high rigidity and high internal loss, thus allowing the loudspeaker to have an improved audio quality. Furthermore, another effect is provided to suppress environment destruction. Furthermore, the degree of freedom for the characteristic of the loudspeaker using the loudspeaker resin molding component and for audio quality adjustment can be increased.

DETAILED DESCRIPTION OF PREFERRED EMBODIMENTS (Embodiment 1)

Figure 1:
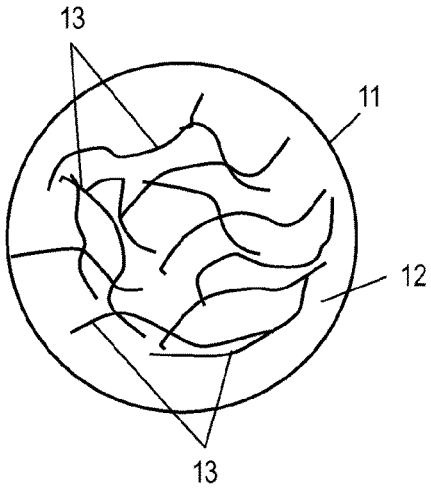
FIG. 1 is a conceptual diagram illustrating a loudspeaker resin molding component of a first example in Embodiment 1.

Hereinafter, Embodiment 1 will be described with reference to the drawings. FIG. 1 is a conceptual diagram illustrating a loudspeaker resin molding component of a first example in Embodiment 1.

As shown in FIG. 1, loudspeaker resin molding component 11 according to Embodiment 1 includes refined carbonized bamboo fibers 13 and resin 12. Refined carbonized bamboo fibers 13 are bamboo fibers that are refined to have a microfibril status and are carbonized.

By this configuration, refined carbonized bamboo fibers 13 provide a synergetic effect of the effect by fibers refined to have a microfibril status and the effect owned by carbonized fibers. As a result, loudspeaker resin molding component 11 can achieve both of a high elastic modulus and a high internal loss.

Figure 2:
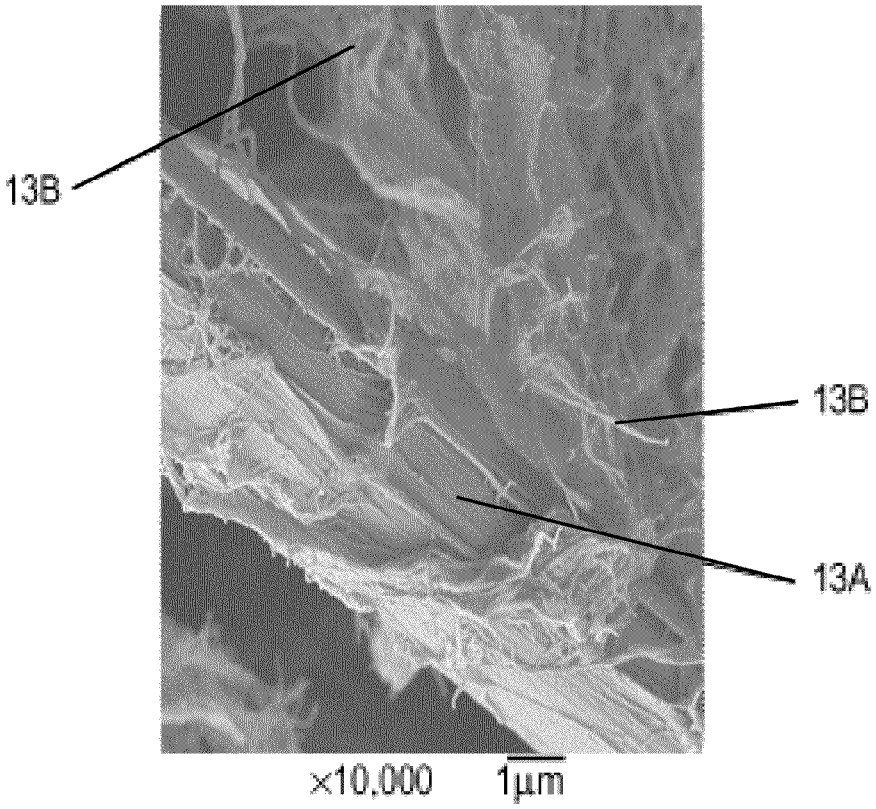
FIG. 2 is an SEM observation view showing a microfibril status of bamboo fibers in the loudspeaker resin molding component according to Embodiment 1.

The synergetic effect provided by refined carbonized bamboo fibers 13 will be described in detail. Bamboo fibers refined to have a microfibril status have a branched structure as shown in FIG. 2. The bamboo fiber has thick truncal part 13A and feathered parts 13B. Feathered parts 13B are thin feathered fibers formed on the surface of truncal part 13A. FIG. 2 is a photograph showing non-carbonized bamboo fibers refined to have a microfibril status. Refined carbonized bamboo fibers 13 also have a structure similar to the above-described one. The structure as described above allows refined carbonized bamboo fibers 13 to have an improved entanglement with resin 12 and other fillers.

Refined carbonized bamboo fibers 13 have a very high hardness. Furthermore, each of refined carbonized bamboo fibers 13 has thick truncal part 13A. Thus, the high rigidity owned by the carbonized bamboo fibers is maintained even when the fibers are refined to have a microfibril status. Thus, refined carbonized bamboo fibers 13 have a very high hardness. In addition, feathered part 13B of refined carbonized bamboo fibers 13 is more easily entangled with resin 12 as described above. As a result, loudspeaker resin molding component 11 has much-improved elasticity compared with that of mere bamboo fibers or mere carbide.

Furthermore, since refined carbonized bamboo fibers 13 have many pores (holes), the carbonized bamboo fibers can have a large surface area, thus increasing the area at which the carbonized bamboo fibers contact with resin 12. This consequently increases the binding capacity between refined carbonized bamboo fibers 13 and resin 12. Thus, in addition to a further-increased elasticity of loudspeaker resin molding component 11, loudspeaker resin molding component 11 can have a further-increased internal loss.

However, in the case of the conventional loudspeaker resin molding component, an increased elastic modulus conflicts with an increased internal loss. To solve the above disadvantage, loudspeaker resin molding component 11 according to the embodiment has the above-described configuration so that loudspeaker resin molding component 11 can provide both of a high elastic modulus and a high internal loss and provides high-audio-quality. As a result, loudspeaker resin molding component 11 can reproduce clear sound having a small distortion. Thus, a loudspeaker including loudspeaker resin molding component 11 of this embodiment can have an improved audio quality.

Refined carbonized bamboo fibers 13 are favorably bound to resin 12 or additive agent such as filler. As a result, the material choices of resin 12 and/or filler used for loudspeaker resin molding component 11 can be increased. Thus, a loudspeaker using loudspeaker resin molding component 11 can have increased characteristics or an increased degree of freedom for audio quality adjustment.

Furthermore, the use of refined carbonized bamboo fibers 13 can suppress the environment destruction.

Figure 3:
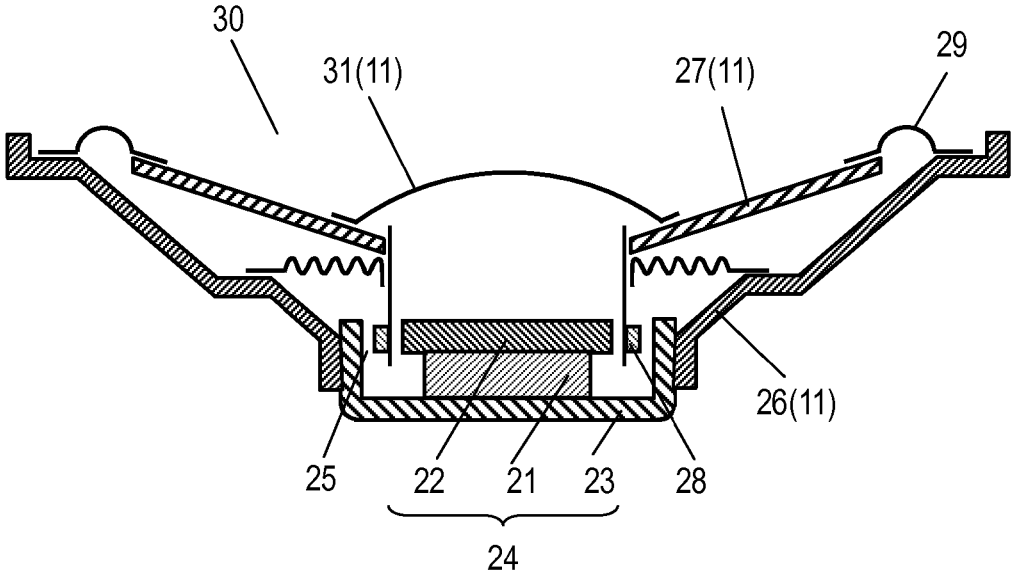
FIG. 3 is a cross-sectional view illustrating a loudspeaker according to Embodiment 1.

Hereinafter, loudspeaker 30 using the loudspeaker molding component in this embodiment will be described in detail. FIG. 3 is a cross-sectional view illustrating a loudspeaker according to Embodiment 1.

As shown in FIG. 3, loudspeaker 30 according to this embodiment includes magnetic circuit 24, frame 26, diaphragm 27, voice coil 28, edge 29 and dust cap 31.

Magnetic circuit 24 includes magnet 21, upper plate 22, and yoke 23. Magnetic circuit 24 is configured so that magnetized magnet 21 is sandwiched between upper plate 22 and yoke 23. Magnetic circuit 24 is connected to a lower part of frame 26.

Edge 29 is adhesively attached to an outer periphery of diaphragm 27. An outer periphery of edge 29 is adhesively attached to a peripheral edge of frame 26. By this configuration, diaphragm 27 is connected to frame 25 via edge 29.

Voice coil 28 is disposed at a back face side (or in the lower direction in FIG. 3) of diaphragm 27 and at a center of diaphragm 27. One end of voice coil 28 is connected to diaphragm 27. The other end of voice coil 28 is inserted in magnetic gap 25 of magnetic circuit 24.

Dust cap 31 is disposed at a front face side of diaphragm 27 and is connected to the center of diaphragm 27.

In the case described above, magnetic circuit 24 is an internal magnet-type circuit. However, the magnetic circuit is not limited to this. As magnetic circuit 24, an external magnet-type circuit is also applicable. When magnetic circuit 24 is an internal magnet-type circuit, yoke 23 is connected to frame 26. When magnetic circuit 24 is an external magnet-type circuit on the other hand, upper plate 22 is connected to frame 26.

Loudspeaker resin molding component 11 of this embodiment is diaphragm 27, frame 26 and dust cap 31. Specifically, in this embodiment, diaphragm 27, frame 26, and dust cap 31 include refined carbonized bamboo fibers 13. In this embodiment, all of diaphragm 27, frame 26, and dust cap 31 include refined carbonized bamboo fibers 13. However, refined carbonized bamboo fibers 13 also may be used for at least one of diaphragm 27, frame 26, and dust cap 31.

By the above configuration, loudspeaker 30 can have the increased internal loss in addition to the improved rigidity and elastic modulus of loudspeaker resin molding component 11. Thus, a resonance in loudspeaker resin molding component 11 is reduced so that loudspeaker 30 can clearly reproduce a high tone, and can reproduce sound in a wide range from a low tone range to a high tone range. As a result, loudspeaker 30 in this embodiment can reproduce sound with a further higher audio quality than in the case where mere bamboo fibers are used. Furthermore, since loudspeaker 30 can reproduce sound in an increased sound pressure level, loudspeaker 30 capable of providing a further-increased output can be realized.

Furthermore, since loudspeaker resin molding component 11 has high rigidity and elastic modulus, the destruction of loudspeaker resin molding component 11 is suppressed even when an excessive signal is inputted to loudspeaker 30 or even when loudspeaker resin molding component 11 receives a load or vibration. Thus, highly-reliable loudspeaker 30 can be realized.

Figure 4:
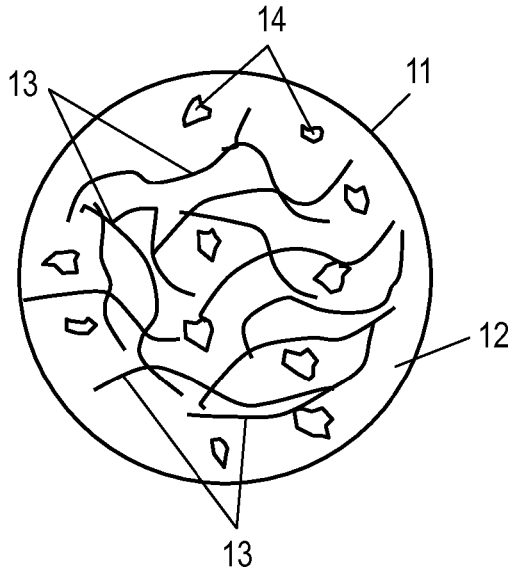
FIG. 4 is a conceptual diagram illustrating a loudspeaker resin molding component of a second example in Embodiment 1.

Next, loudspeaker resin molding component 11 in this embodiment will be described. FIG. 4 is a conceptual diagram illustrating a loudspeaker resin molding component of a second example in Embodiment 1. In this example, loudspeaker resin molding component 11 includes resin 12, refined carbonized bamboo fibers 13, and additive agent 14. Loudspeaker resin molding component 11 is formed by injection-molding or sheet-molding the bamboo fibers, resin 12, and additive agent 14. Thus, loudspeaker resin molding component 11 can have improved productivity and dimensional stability.

In this example, refined carbonized bamboo fibers 13 have a freeness in the range from 0 cc to 37 cc. The relation between the freeness of refined bamboo fibers and the tension strength of the papermaking product using the refined bamboo fibers is shown in Table 1.

TABLE 1

| Freeness (cc) | Tension strength (MPa) |
|---|---|
| 550 | 15 |
| 80 | 33 |
| 53 | 39 |
| 37 | 49 |
| 5 | 50 |

As shown in Table 1, the papermaking product shows an improved strength by refining bamboo fibers. This shows that the entanglement among the refined bamboo fibers is promoted to thereby improve the strength of the papermaking product. Refined carbonized bamboo fibers 13 also show a similar effect. Thus, the entanglement among refined carbonized bamboo fibers 13 in resin 12 is promoted, thus improving the strength of loudspeaker resin molding component 11.

When refined carbonized bamboo fibers 13 have a freeness of 550 cc or more, the carbonized bamboo fibers have an insufficient freeness. When refined carbonized bamboo fibers 13 have a freeness of 80 cc, the carbonized bamboo fibers have a sufficient freeness. While a freeness of refined carbonized bamboo fibers 13 is changing from 550 cc to 80 cc, the tension strength of refined carbonized bamboo fibers 13 is gradually increasing.

When refined carbonized bamboo fibers 13 have a freeness lower than 80 cc, the tension strength of refined carbonized bamboo fibers 13 is improved at a relatively-high rate. The tension strength of refined carbonized bamboo fibers 13 is in a saturated status when the freeness is lower than about 37 cc. Specifically, by allowing refined carbonized bamboo fibers 13 to have a freeness in the range between 0 cc to 37 cc, the refined bamboo fibers can provide a stable reinforcement effect to loudspeaker resin molding component 11. Due to this reason, refined carbonized bamboo fibers 13 in this embodiment have a freeness of 37 cc or less. As a result, even when the material has a different tension strength for example, loudspeaker resin molding component 11 having a stable rigidity can be obtained.

When refined carbonized bamboo fibers 13 have an average fibers diameter larger than 5 μm, an action to promote the entanglement among the fibers is reduced. Thus, refined carbonized bamboo fibers 13 are suppressed from realizing a superior characteristic in loudspeaker resin molding component 11. Thus, in this embodiment, refined carbonized bamboo fibers 13 have an average fibers diameter smaller than 5 μm and have an L/D (average fiber length/average fiber diameter) of 10 or more. As a result, refined carbonized bamboo fibers 13 are favorably entangled with resin 12 and/or additive agent 14 such as filler. This consequently can realize loudspeaker resin molding component 11 having a high rigidity.

In this embodiment, refined carbonized bamboo fibers 13 can be manufactured by a mixer, a beater, a refiner, a pressure-type homogenizer, an ultrasonic homogenizer, a crusher using beads composed of glass or zirconia as raw material, or an uniaxial or multiaxis extruder, for example.

Refined carbonized bamboo fibers 13 are desirably obtained by a high carbonization temperature of 500° C. or more. By the carbonization at a temperature of 500° C. or more, hard refined carbonized bamboo fibers 13 can be obtained.

Refined carbonized bamboo fibers 13 are desirably mixed in an amount at 3 weight % or more and 30 weight % or less. If refined carbonized bamboo fibers 13 are included in an amount lower than 3 weight %, the action to improve the bending elastic modulus of loudspeaker resin molding component 11 is small. When refined carbonized bamboo fibers 13 are included in an amount exceeding 30 weight % on the other hand, it is difficult to allow the refined bamboo fibers to be evenly dispersed in resin 12. Furthermore, fluidity of refined carbonized bamboo fibers 13 is deteriorated, thus making it difficult to mold loudspeaker resin molding component 11 having a thin thickness by injection molding.

Therefore, the effect of refined carbonized bamboo fibers 13 as described above can be most effectively achieved by allowing refined carbonized bamboo fibers 13 to be included in an amount of 3 weight % or more and 30 weight % or less.

Refined carbonized bamboo fibers 13 may be obtained from any bamboo as long as the bamboo is a Bambusaceous plant except for bamboo having an age of 1 year or less and a bamboo shoot. As described above, loudspeaker resin molding component 11 is formed by refined carbonized bamboo fibers 13 obtained from bamboo having an age of 1 year or more. As a result, loudspeaker resin molding component 11 can secure acoustic characteristics required for loudspeaker resin molding component 11 (e.g., high rigidity, strength, large internal loss). Refined carbonized bamboo fibers 13 made from bamboo having an age of 2 years or more have slightly-increased rigidity and strength depending on the age. Thus, refined carbonized bamboo fibers 13 obtained from bamboo having an age of 1 year or more are used in this embodiment.

Generally, trees for wood material such as needle-leaf trees and broad-leaf trees require 40 or more years to grow. Thus, once such trees are cut down, forest requires a very long time to regenerate. Therefore, an excessive tree trimming causes environment destruction. On the other hand, bamboos grow very fast compared with needle-leaf trees and broad-leaf trees. Thus, one year or more is sufficient for bamboo forest to regenerate to a level similar to that before the trimming, thus suppressing the nature destruction of the bamboo forest. Thus, bamboo is a very effective material from the view point of the use of a limited resource on the earth. As described above, loudspeaker resin molding component 11 using bamboo can suppress the environment destruction compared with the one using wood. Furthermore, since one year or more is sufficient for bamboo forest to regenerate, refined carbonized bamboo fibers 13 can be obtained in a stable, continuous, and low-cost manner. Therefore, low-cost loudspeaker resin molding component 11 can be provided.

As same as the refined non-carbonized bamboo fibers shown in FIG. 2, refined carbonized bamboo fibers 13 have thick truncal part 13A. Thus, even in a carbonized status, the high rigidity owned by bamboo fibers is not lost, thus refined carbonized bamboo fibers 13 provides a very-high hardness. In addition, refined carbonized bamboo fibers 13 allow feathered part 13B to be easily entangled with resin 12 and/or additive agent 14 such as filler. As a result, loudspeaker resin molding component 11 has such a rigidity that is significantly improved than in the case where mere refined bamboo fibers or mere carbonized fibers are used.

Furthermore, refined carbonized bamboo fibers 13 are carbonized at a high temperature (a temperature at least 500° C. or more). Thus, refined carbonized bamboo fibers 13 include therein many pores (holes). This consequently provides a further improved entanglement with resin 12 and filler. Furthermore, pores (mainly on the surface) of refined carbonized bamboo fibers 13 are filled with resin 12. As a result, refined carbonized bamboo fibers 13 contact with resin 12 in an increased area. Therefore, loudspeaker resin molding component 11 can have increased rigidity and elastic modulus as well as an increased internal loss compared with a loudspeaker resin molding component using mere refined bamboo fibers or mere carbonized fibers.

If refined carbonized bamboo fibers 13 are carbonized at a further higher temperature (800° C. or more), refined carbonized bamboo fibers 13 include therein more pores. Thus, loudspeaker resin molding component 11 can have the further increased rigidity and elastic modulus and the further increased internal loss.

As described above, loudspeaker resin molding component 11 including refined carbonized bamboo fibers 13 can realize both of a high rigidity and a large internal loss by the synergetic effect of the carbonization and refining of the bamboo fibers. As a result, loudspeaker resin molding component 11 can reduce an undesired resonance, reduce distortion, improve the sound pressure, and expand the reproduction band, thus providing loudspeaker 30 having a higher audio quality.

Generally, when non-refined carbonized material is used, this carbonized material has a low affinity for resin material, thus suppressing the carbonized material from effectively functioning as reinforcing material. In such a case, the unrefined carbonized material must be subjected to a surface processing (e.g., silane processing). However, refined carbonized bamboo fibers 13 have an anchor effect of feathered part 13B with respect to resin 12 and additive agent 14. This consequently causes an increased affinity between refined carbonized bamboo fibers 13, and resin 12 and additive agent 14, thus improving the mechanical adhesiveness between refined carbonized bamboo fibers 13, and resin 12 and additive agent 14. Thus, loudspeaker resin molding component 11 having a high rigidity can be obtained.

In view of the above, refined carbonized bamboo fibers 13 in this embodiment are not subjected to a surface processing. As described above, the surface processing step of refined carbonized bamboo fibers 13 also can be deleted or simplified. This can consequently reduce the number of the steps for the surface processing of refined carbonized bamboo fibers 13, thus providing low-cost loudspeaker resin molding component 11. If refined carbonized bamboo fibers 13 are subjected to a surface processing, the mechanical adhesiveness between refined carbonized bamboo fibers 13, and resin 12 and additive agent 14 can be further improved. In this case, loudspeaker resin molding component 11 having a further-higher rigidity can be obtained.

When resin 12 is poorly bound to additive agent 14, loudspeaker resin molding component 11 cannot obtain desired characteristics (e.g., strength, elastic modulus, internal loss). For example, polypropylene resin (nonpolar) is poorly bound to polar additive agent 14. In the present embodiment, refined carbonized bamboo fibers 13 are entangled with resin 12 and additive agent 14, thereby increasing the binding capacity with resin 12 and additive agent 14. Thus, loudspeaker resin molding component 11 can employ a wider range of materials. As a result, loudspeaker resin molding component 11 can realize a conventionally-unachievable characteristic and a wide range of audio qualities.

As described above, loudspeaker resin molding component 11 can allow the loudspeaker to have a wider range of audio qualities while retaining the moisture resistance and water resistance of the resin. Furthermore, loudspeaker 30 can handle a high output, has a superior appearance, and can improve the productivity. Thus, loudspeaker 30 using loudspeaker resin molding component 11 can be mounted to an acoustic device outputting a high volume, an acoustic device for an outdoor use, and an automobile, in addition to a general electronic device, thus increasing the applications of loudspeaker 30.

Next, additive agent 14 will be described. In order to reproduce required sound, loudspeaker resin molding component 11 is added with various additive agents 14. Additive agents 14 are added as reinforcement material of loudspeaker resin molding component 11. Example of additive agents 14 includes natural fibers, mica, graphite, talc, calcium carbonate, clay, carbon fibers, and aramid fibers.

Any natural fibers may be used such as wood fibers or non-wood fibers. Wood fibers may be obtained from needle-leaf trees or broad-leaf trees for example. Non-wood fibers may be obtained from non-wood material such as bamboos, kenaf, jute, Manila hemp, and gampi. Trees such as Needle-leaf trees and broad-leaf trees require 40 or more years to grow. Thus, once such trees are cut down, forest requires a very long time to regenerate. Thus, an excessive tree trimming causes environment destruction. On the other hand, non-wood materials grow very fast compared with needle-leaf trees and broad-leaf trees, thus suppressing the nature destruction.

Generally, non-wood fibers are tough and rigid compared with wood fibers. Thus, loudspeaker resin molding component 11 added with non-wood fibers can have an increased rigidity, thus providing the reproduction of a clear audio quality free from distortion, and of clear sound.

When non-carbonized fibers of bamboo (hereinafter referred to as non-carbonized bamboo fibers) are used in particular, loudspeaker resin molding component 11 can have a further-increased rigidity. The reason is that non-carbonized bamboo fibers also have a high rigidity and a light weight as same as carbonized bamboo fibers. In this case, when bamboo fibers (combination of non-carbonized bamboo fibers and refined carbonized bamboo fibers 13) are mixed at a ratio lower than 3 weight %, the effect by the bamboo fibers are substantially suppressed from appearing. When the bamboo fibers are mixed at a ratio higher than 60 weight % on the other hand, a long time is required to knead the bamboo fibers and resin 12 and injection molding may be difficult. This consequently causes a reduced productivity of loudspeaker resin molding component 11. Furthermore, since loudspeaker resin molding component 11 has a declined dimensional stability, loudspeaker resin molding component 11 has a reduced degree of freedom in shape.

Therefore, bamboo fibers are desirably mixed in resin 12 in an amount of 3 weight % or more and 60 weight % or less. By mixing the bamboo fibers in resin 12 in an amount within the above ratio, the bamboo fibers can provide the effect efficiently and can improve the productivity and quality.

By including bamboo fibers in an amount exceeding 51 weight %, loudspeaker resin molding component 11 can be incinerated and disposed in contrast with a conventional loudspeaker resin molding component formed only by petroleum-derived resin 12.

Non-carbonized bamboo fibers desirably have a freeness in a range from 0 cc to 37 cc, inclusive. When non-carbonized bamboo fibers refined to such a level are compared with not-refined non-carbonized bamboo fibers, the former has a higher elastic modulus. Furthermore, the existence of feathered part 13B improves the binding among refined non-carbonized bamboo fibers and the binding between refined non-carbonized bamboo fibers and refined carbonized bamboo fibers 13. Thus, the synergetic effect of the above factors allows loudspeaker resin molding component 11 added with refined non-carbonized bamboo fibers to have a higher elastic modulus than that of loudspeaker resin molding component 11 added with non-refined non-carbonized bamboo fibers.

Non-carbonized bamboo fibers may be partially or entirely substituted with a bamboo powder. The use of the bamboo powder allows loudspeaker 30 to output more natural and clearer sound.

Alternatively, non-carbonized bamboo fibers may be partially or entirely substituted with (not-refined) pulverized bamboo charcoal. This configuration can allow loudspeaker resin molding component 11 to have increased elastic modulus and internal loss. The pulverized bamboo charcoal is obtained by carbonizing bamboo pieces cut to have an appropriate length at a temperature of about 500° C. or more, then pulverizing the carbonized bamboo pieces. The pulverized bamboo charcoal desirably has a particle diameter of 150 μm or less. The pulverized bamboo charcoal having a particle diameter larger than 150 μm makes it difficult to disperse the pulverized bamboo charcoal in resin 12, thereby causing a tendency where loudspeaker resin molding component 11 has a defective appearance or variation in quality. The pulverized bamboo charcoal preferably has a particle diameter close to the size of refined carbonized bamboo fibers 13. By doing this, the pulverized bamboo charcoal is dispersed in resin 12 or refined carbonized bamboo fibers 13 in a favorable manner.

When mica is added as additive agent 14, loudspeaker resin molding component 11 can have an increased elastic modulus. When graphite is added, loudspeaker resin molding component 11 can have increased elastic modulus and internal loss. When talc, calcium carbonate, and clay are added, loudspeaker resin molding component 11 can have an increased internal loss. When aramid fibers are added, the entanglement between refined carbonized bamboo fibers 13 and the aramid fibers can allow loudspeaker resin molding component 11 to have an increased internal loss without causing a decrease in the elastic modulus of loudspeaker resin molding component 11. When aramid fibers refined to a microfibril status are added, the entanglement between and refined carbonized bamboo fibers 13 and the aramid fibers refined to a microfibril status is further increased, thus providing loudspeaker resin molding component 11 having a further-higher elastic modulus and a further-larger internal loss. Alternatively, as chemical fibers, fibers having a high strength and a high elastic modulus fibers like carbon fibers also may be used.

Next, resin 12 will be described. Resin 12 is desirably olefin resin. Each of polymethylpentene and polypropylene has a small specific gravity. Thus, the use of such resin having a small specific gravity also can reduce the weight of loudspeaker resin molding component 11. Polypropylene in particular is crystalline resin that has a relatively-high heat resistance and good moldability.

Depending on an application, crystalline resin and non-crystalline resin are used as resin 12. When a high heat resistance or a high solvent resistance is required, engineering plastic is used as resin 12. As a result, loudspeaker resin molding component 11 utilizing the property value of the resin material can be obtained.

Alternatively, plant-derived resins can be used as resin 12 to be considerate to the environment. Among the plant-derived resins, polylactic acid in particular is highly compatible with refined carbonized bamboo fibers 13 than in the case of polypropylene. Refined carbonized bamboo fibers 13 also promote the crystallization of polylactic acid. Thus, loudspeaker resin molding component 11 can have further-improved strength and heat resistance. Furthermore, molding manhours (cooling time) can be reduced, thus providing low-cost loudspeaker resin molding component 11.

Furthermore, when mica or talc is added as additive agent 14, mica or talc functions as crystallization promoter, thus further promoting the crystallization of polylactic acid. In this embodiment, refined carbonized bamboo fibers 13 also promote the crystallization of polylactic acid. Thus, a reduced amount of crystallization promoter such as mica or talc can be added, thus achieving loudspeaker resin molding component 11 having a lighter weight.

Polypropylene is nonpolar resin. Thus, polypropylene may be added with compatibilizer. In this case, an improved compatibility can be provided between nonpolar resin 12 and refined carbonized bamboo fibers 13. This can consequently improve the binding between resin 12 and refined carbonized bamboo fibers 13 and can improve the elastic modulus and the heat resistance of loudspeaker resin molding component 11.

In particular, a compatibilizer may be silane having a vinyl group, a methacryloxy group, or a mercapto group. Such a compatibilizer includes vinyltrimethoxy silane, vinyltriethoxy silane, 3-methacryloyloxypropylmethyldimethoxy silane, 3-methacryloxypropyltrimethoxy silane, 3-methacryloxypropylmethyldiethoxy silane, 3-methacryloxypropyltriethoxy silane, 3-mercapto propylmethyldimethoxy silane, and 3-mercapto propyltrimethoxysilane.

The compatibilizer is not limited to this. Thus, other silane coupling agents also may be used. Alternatively, nonpolar resin 12 may be denatured by maleic anhydride, for example, to allow resin 12 to be polar. When polylactic acid is used as resin 12, tannin may be used as the compatibilizer.

Refined carbonized bamboo fibers 13 are more highly compatible with resin 12 than non-refined bamboo fibers, thus allowing a reduced amount of the compatibilizer to be used.

As described above, according to loudspeaker resin molding component 11 of the present embodiment, refined carbonized bamboo fibers 13 also function as a compatibilizer. Thus, by appropriately combining these materials, loudspeaker resin molding component 11 can have a wide range of property values. Therefore, loudspeaker 30 having a wide range of audio qualities can be obtained by combining selected loudspeaker resin molding components 11.

Since refined carbonized bamboo fibers 13 are black, it is not needed to add coloring agent such as the black one.

Figure 5:
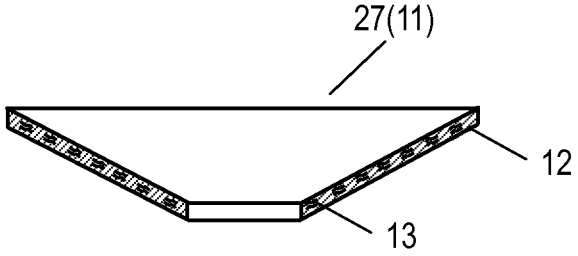
FIG. 5 is a cross-sectional view illustrating a loudspeaker resin molding component of a third example in Embodiment 1.
Figure 6:
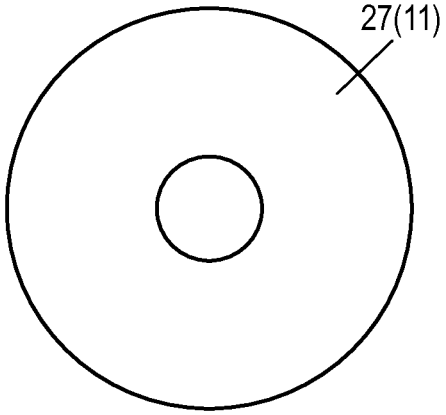
FIG. 6 is a top view illustrating the loudspeaker resin molding component of the third example in Embodiment 1.

FIG. 5 is a cross-sectional view illustrating a loudspeaker resin molding component of a third example in Embodiment 1. FIG. 6 is a top view illustrating the loudspeaker resin molding component of the third example in Embodiment 1. Loudspeaker resin molding component 11 in this example is diaphragm 27.

As shown in FIG. 5 and FIG. 6, diaphragm 27 in this example is obtained by injection molding material including resin 12 and refined carbonized bamboo fibers 13. Alternatively, diaphragm 27 may be formed by sheet molding. Furthermore, diaphragm 27 also may be added with additive agent 14 as shown in FIG. 4. Diaphragm 27 in this example may use any of the configurations of loudspeaker resin molding component 11 in the second example.

This configuration can allow diaphragm 27 to have a sufficient rigidity and high toughness. Since the refined carbonized bamboo fibers have a very-small specific gravity, diaphragm 27 can have a very-light weight. As a result, diaphragm 27 can have improved rigidity and sound speed, thus reducing the distortion of diaphragm 27. By these configurations, diaphragm 27 can have an improved sound pressure level and an improved audio quality (e.g., an expanded high-pass limiting frequency). Diaphragm 27 in this embodiment shows a remarkably-improved sound pressure level in a high range.

Diaphragm 27 provides both of improved elastic modulus and internal loss by including refined carbonized bamboo fibers 13. Specifically, by being both refined and carbonized, refined carbonized bamboo fibers 13 provide a synergetic effect. Thus, diaphragm 27 can have an increased reproduction band and thus diaphragm 27 can reproduce clear sound in a wide frequency range. Specifically, the resonance caused by an insufficient rigidity of a diaphragm can be reduced and a clear and high sound pressure level can be obtained with a low distortion in a high tone range. Furthermore, favorable low-frequency sound can be also reproduced in a favorable low tone range.

In refined carbonized bamboo fibers 13, more pores are generated with an increase of the carbonization temperature. Thus, refined carbonized bamboo fibers 13 used for diaphragm 27 of this example are carbonized at a temperature of 800° C. or more. This consequently generates an increased number of pores, thus increasing the internal loss. Since refined carbonized bamboo fibers 13 are hard, diaphragm 27 can have a high elastic modulus. Therefore, diaphragm 27 can achieve both of a high elastic modulus and a high internal loss.

By the widespread use of digital techniques in recent years, electronic devices such as an acoustic device and a video device have a higher audio quality. Thus, loudspeaker 30 shown in FIG. 3 used for the electronic devices is required to provide an improved performance. On the other hand, among components constituting the loudspeaker, diaphragm 27 is the most important determinant factor regarding the performance and audio quality of loudspeaker 30. Thus, the use of diaphragm 27 can provide loudspeaker 30 that can realize a high audio quality satisfying the market need.

A conventional resin-made diaphragm has a disadvantage that a loudspeaker characteristic and an audio quality adjustment range are extremely narrow. Furthermore, a diaphragm composed of the combination of resin and pulp material have to have an increased strength in order to improve the audio quality of the diaphragm.

Thus, the present embodiment uses the above-described configuration to solve the above disadvantage. Specifically, the embodiment allows diaphragm 27 to have an increased degree of freedom of a strength and an internal loss value and allows loudspeaker 30 to have an increased degree of freedom for characteristics and the audio quality adjustment. Furthermore, diaphragm 27 can secure the moisture resistance reliability and a superior appearance. In addition, diaphragm 27 can have an improved productivity.

Next, how to create the characteristics and sound of loudspeaker 30 will be described. Diaphragm 27 is prepared by combining various materials such as resin or additive agent so as to have desired property value and audio quality. In order to realize the characteristics of diaphragm 27 (characteristics creation) and audio quality (sound creation), know-hows are required. However, such creations are generally carried out by the method as shown below. Specifically, the characteristics and sound of loudspeaker 30 are created by changing the parameter of the components of loudspeaker 30.

For example, in a case where, among the components of loudspeaker 30, the parameters of the other components other than diaphragm 27 are fixed, how to create the characteristic and sound of loudspeaker 30 will be described.

Variable parameters of diaphragm 27 include a material property value of diaphragm 27 itself as well as the area, shape, weight, thickness of diaphragm 27 and the like. The sound pressure frequency characteristics and the audio quality of the loudspeaker are generally determined based on conditions other than the material property value of diaphragm 27. However, the specification of diaphragm 27 such as the area, shape, weight, and thickness is substantially determined by a customer requirement or the like at an initial stage for designing loudspeaker 30.

Then, diaphragm 27 is prepared based on the determined specification (e.g., area, shape, weight, thickness). However, diaphragm 27 in many cases causes undesired peak or dip in the sound pressure frequency characteristics. As a result, at a specific frequency range, diaphragm 27 has a high distortion or an audio quality significantly depending on the sound pressure frequency characteristics. These distortion and sound pressure frequency characteristics are generally caused by the area, shape, weight, or thickness of diaphragm 27 and are determined by the vibration mode of diaphragm 27, in particular. In order to suppress the undesired peak or dip or distortion to obtain a favorable audio quality, material used for diaphragm 27 is selected.

Hereinafter, a method of selecting material used for diaphragm 27 will be described. Diaphragm 27 in this example includes, as shown in FIG. 4, resin 12, refined carbonized bamboo fibers 13, and additive agent 14. Thus, resin 12 and additive agent 14 are firstly selected so as to seem to satisfy the sound pressure frequency characteristic, the audio quality, or the reliability for example required for the loudspeaker.

Material for resin 12 is selected so that diaphragm 27 to be formed provides sound close to that when 100% resin 12 is used for forming a diaphragm. However, since loudspeaker 30 generates heat, it is necessary to select material for resin 12 in consideration of a heat resistance reliability.

When resin 12 and additive agent 14 are selected and adding amount of resin 12, refined carbonized bamboo fibers 13, and additive agent 14 are determined, the selection and determination are carried out in consideration of the density, elastic modulus, internal loss, and timbre (tone color) which are unique to the respective materials, and the resonance frequencies due to the individual materials when the materials are molded to have the shape of diaphragm 27.

For example, when an undesired peak or dip is caused in the sound pressure frequency characteristics, a method of suppressing the peak or the dip will be described.

In order to suppress the dip of diaphragm 27, such resin material is selected that has a resonance frequency at a frequency including the dip. In order to suppress the peak of diaphragm 27 on the contrary, material such as additive agent 14 is selected that has an internal loss in the frequency including the peak.

Next, a master batch pellet is prepared that is highly filled with selected resin 12, refined carbonized bamboo fibers 13, and additive agent 14. Diaphragm 27 is prepared by injection molding this master batch pellet.

With regard to diaphragm 27 thus obtained, the property values and the like are measured and evaluated. Furthermore, diaphragm 27 is used to form the loudspeaker as shown in FIG. 3 as an example. Then, the characteristics and the audio quality are actually measured and the resultant sound is listened for final evaluation. When a desired characteristic or audio quality are not provided in this evaluation, the sample preparation process is performed again. By such trial and error, optimal material and the mixing ratio thereof are determined.

As shown in FIG. 5 and FIG. 6, diaphragm 27 is formed by injection molding or sheet molding material obtained by mixing resin 12 with refined carbonized bamboo fibers 13. This configuration achieves both of a high elastic modulus and a large internal loss, thus allowing diaphragm 27 to generate peak or dip relatively few. Therefore, a reduced number of sample preparations are required to select resin 12 and to determine the type and adding amount of additive agent 14.

Figure 7:
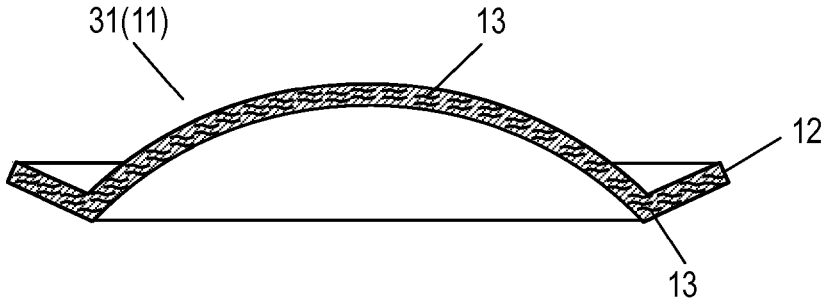
FIG. 7 is a cross-sectional view illustrating a loudspeaker resin molding component of a fourth example in Embodiment 1.

FIG. 7 is a cross-sectional view illustrating a loudspeaker resin molding component in a fourth example of Embodiment 1. Loudspeaker resin molding component 11 of the fourth example in this embodiment is dust cap 31.

As shown in FIG. 7, dust cap 31 in this example is formed by injection molding the material obtained by mixing resin 12 with refined carbonized bamboo fibers 13. Additive agent 14 as shown in FIG. 4 also may be added. Dust cap 31 also may be formed by sheet molding. Dust cap 31 in this example also may use any configuration of loudspeaker resin molding component 11 in the first or second example.

By this configuration, dust cap 31 can have a sufficient rigidity and a high toughness. Specifically, the synergetic effect is provided by refining of the bamboo fibers and the carbonization thereof. Furthermore, the refined carbonized bamboo fibers have a very-small specific gravity, thus allowing dust cap 31 to have a very-light weight. As a result, dust cap 31 can have improved rigidity and sound speed, thus reducing the distortion of dust cap 31. By these configurations, dust cap 31 can have an improved audio quality (e.g., an improved sound pressure level in a high tone range, an expanded limiting frequency at the high range side).

Furthermore, loudspeaker 30 using dust cap 31 can reproduce clear sound. Specifically, the resonance caused by an insufficient rigidity of dust cap 31 can be reduced. Furthermore, loudspeaker 30 providing a clear and high sound pressure level with a low distortion in a high tone range can be realized.

By the widespread use of digital techniques in recent years, electronic devices such as an acoustic device and a video device have a higher audio quality. Thus, loudspeaker 30 as shown in FIG. 3 used for the electronic devices is required to provide an improved performance. Meanwhile, among the performance and the audio quality of loudspeaker 30, dust cap 31 is an important determinant factor regarding the reproduction of high tone range sound. Thus, the use of dust cap 31 can provide loudspeaker 30 that can reproduce high tone range sound with a high audio quality satisfying the market need.

Dust cap 31 mainly contributes to the reproduction of a high tone. Thus, dust cap 31 is not required to have flat sound pressure characteristics in a wide reproduction frequency range, less than diaphragm 27. In other words, dust cap 31 may have a lower internal loss than that of diaphragm 27. Thus, refined carbonized bamboo fibers 13 in this example are carbonized at a temperature of 500° C. or more.

Among the reproduction bands of the loudspeaker, the dust cap performs a high tone-range reproduction band from among a medium-to-high tone range, in particular. Refined bamboo fibers and refined carbonized bamboo fibers 13 provide favorable characteristics and audio quality from a medium-to-high tone range to a high tone range. Thus, refined bamboo fibers and refined carbonized bamboo fibers 13 are optimal material to be added to dust cap 31 from these viewpoints.

Refined bamboo fibers and refined carbonized bamboo fibers 13 have a very high hardness. Refined bamboo fibers and refined carbonized bamboo fibers 13 have feathered part 13B as shown in FIG. 2 and thus are easily entangled with resin 12 and the additive agent. Thus, this provides an effect to increase the rigidity of dust cap 31 and to significantly improve the high-range characteristics.

A subcone has a reproduction band similar to that of dust cap 31 described in this example. Thus, as shown in FIG. 4, resin 12, refined carbonized bamboo fibers 13, and additive agent 14 also may be used to manufacture a subcone. The subcone in this case also can provide the same effect as that of dust cap 31.

Figure 8:
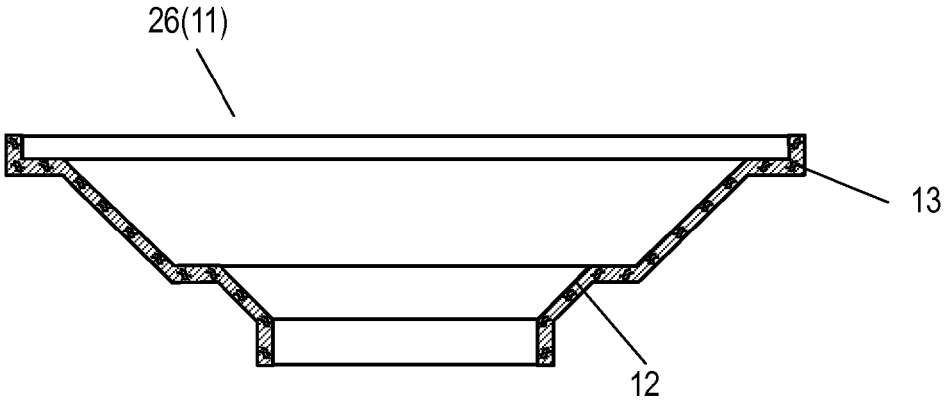
FIG. 8 is a cross-sectional view illustrating a loudspeaker resin molding component of a fifth example in Embodiment 1.

FIG. 8 is a cross-sectional view illustrating a loudspeaker resin molding component in a fifth example of Embodiment 1. Loudspeaker resin molding component 11 in this example is frame 26.

As shown in FIG. 8, frame 26 is formed by injection molding the material obtained by mixing resin 12 with refined carbonized bamboo fibers 13. Additive agent 14 as shown in FIG. 4 also may be added to the material. Frame 26 also may be formed by sheet molding. Frame 26 in this example may use any configuration of loudspeaker resin molding component 11 in the second example.

By this configuration, the synergetic effect is provided by refining of the bamboo fibers and the carbonization thereof. Specifically, frame 26 can have sufficient rigidity and high toughness. Furthermore, in addition to improved rigidity and high toughness, the internal loss also can be improved. This consequently provides a higher damping by frame 26 to thereby suppress an undesired resonance of frame 26, thus providing a favorable audio quality having reduced distortion. As a result, loudspeaker 30 shown in FIG. 3 can reproduce sound having a favorable audio quality.

Refined carbonized bamboo fibers 13 are resistant to moisture. Thus, frame 26 having a high moisture resistance reliability can be realized. Furthermore, since frame 26 can be formed by injection molding or sheet molding, frame 26 can have a good appearance and a high productivity.

A conventional loudspeaker frame is formed by metal or resin. In the case of a conventional loudspeaker frame formed by metal, for example, an iron plate or an aluminum die casting is used. However, a frame obtained by the iron plate or aluminum die casting has a very high weight.

A conventional loudspeaker frame using resin on the other hand has a low rigidity. Thus, in order to provide an increased strength to the conventional loudspeaker frame, the conventional loudspeaker frame using resin is added with inorganic fillers such as glass fibers or mica. Generally, in order to satisfy the acoustic performance, inorganic filler of a weight ratio of 30% or more is added to the frame. However, the addition of the inorganic filler causes an increased specific gravity, thus causing the frame to have an increased weight. When glass fibers are used in order to improve the shock resistance on the other hand, a risk of environment destruction may be caused.

In view of the above, frame 26 in this embodiment is formed of resin 12 to be added with refined carbonized bamboo fibers 13. Resin 12 and refined carbonized bamboo fibers 13 are hard and has a very-small specific gravity. This can consequently increase the strength of frame 26 and can reduce the weight of frame 26. Thus, when frame 26 is mounted in a mobile apparatus (shown in FIG. 10), which will be described later, in particular, frame 26 can contribute to an improvement of fuel consumption, running performance and the like of the mobile apparatus. The use of refined carbonized bamboo fibers 13 suppresses the environment destruction.

Generally, frame 26 may have a lower internal loss than that of diaphragm 27. Thus, refined carbonized bamboo fibers 13 in this example may be carbonized at a temperature of 500° C. or more.

Although polypropylene is used as resin 12 used for frame 26 in this example, resin 12 is not limited to polypropylene. For example, resin 12 used for frame 26 also may be polycarbonate. The use of polycarbonate can improve the strong toughness of frame 26.

(Embodiment 2)

Figure 9:
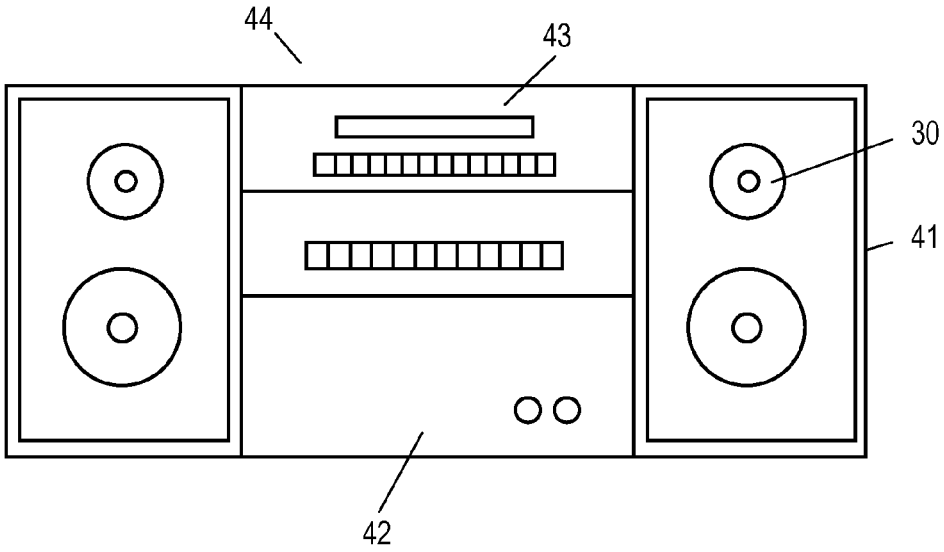
FIG. 9 is an external view illustrating an electronic device according to Embodiment 2.

FIG. 9 is an external view illustrating an electronic device according to Embodiment 2. In this embodiment, audio mini stereo 44 will be described as an example of the electronic device.

Audio mini stereo 44 includes amplifier 42, operation section 43, enclosure 41, and loudspeakers 30 shown in Embodiment 1. Loudspeaker 30 used for mini stereo 44 in this embodiment may use loudspeaker resin molding component 11 of any example in Embodiment 1.

Loudspeaker 30, operation section 43, and amplifier 42 are mounted in enclosure 41. Operation section 43 such as a player outputs a signal to amplifier 42. Amplifier 42 amplifies the inputted signal and outputs the amplified signal to loudspeakers 30. Then, loudspeakers 30 receive power supplied from amplifier 42 of a main body to emit sound.

By this configuration, mini stereo 44 can reproduce clear sound. Furthermore, in a low tone range, favorable low-frequency sound can be reproduced. Clear-and-high-quality sound also can be reproduced in a high tone range. Furthermore, the sound pressure in a high tone range also can be obtained, thus reproducing the sound in a wide band frequency. Thus, mini stereo 44 can reproduce sound with a favorable audio quality.

Although audio mini stereo 44 is described as an application to the electronic device of loudspeaker 30, the electronic device is not limited to this. The embodiment also can be widely applied and developed to a portable audio device, a video device (e.g., liquid crystal television, plasma display television), an information communication device (e.g., mobile phone), or an electronic device such as a computer-related device.

(Embodiment 3)

Figure 10:
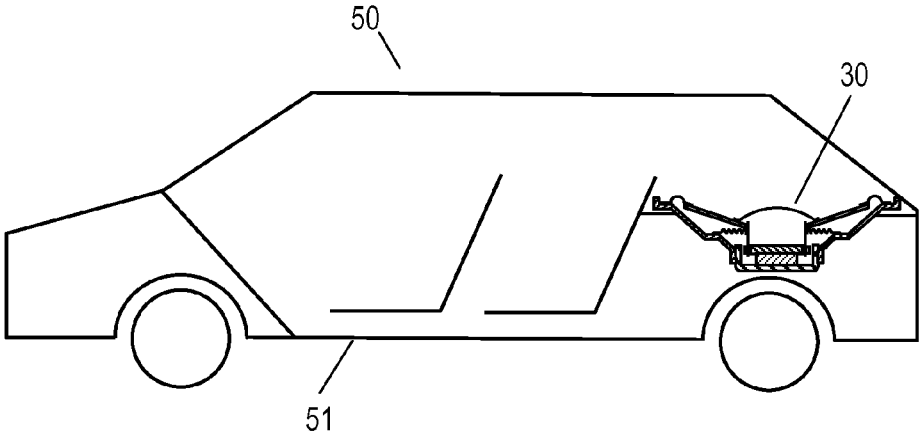
FIG. 10 is a conceptual diagram illustrating a mobile apparatus according to Embodiment 3.

FIG. 10 is a conceptual diagram illustrating a mobile apparatus according to Embodiment 3. In this embodiment, automobile 50 will be described as an example of the mobile apparatus.

As shown in FIG. 10, automobile 50 in this embodiment includes movable main body 51 and loudspeaker 30 shown in Embodiment 1. Loudspeaker 30 is accommodated in main body 51. For example, loudspeaker 30 is mounted in a rear tray or a front panel and is used as a part of a car navigation system or a car audio system. Loudspeaker 30 used for automobile 50 in this embodiment may use loudspeaker resin molding component 11 in any example in Embodiment 1.

By this configuration, the superior characteristics of loudspeaker 30 as described above can be utilized. Specifically, automobile 50 including loudspeaker 30 can have an improved audio quality.

When frame 26 in Embodiment 1 as shown in FIG. 8 is used to loudspeaker 30, in particular, loudspeaker 30 has a very light weight, thus contributing to improvement of fuel consumption of automobile 50. Thus, carbon dioxide emission and fossil fuel reduction due to automobile 50 are suppressed.

A loudspeaker diaphragm, a loudspeaker, an electronic device, and an apparatus according to the present embodiments can be applied to an electronic device requiring accurate characteristics and sound (e.g., video acoustic device, information communication device) and an apparatus (e.g., automobile).

What is claimed is:

1. A loudspeaker resin molding component comprising:

carbonized bamboo fibers that are refined to have a microfibril status; and resin, wherein the refined carbonized bamboo fibers have a freeness of 37 cc or less, and the refined carbonized bamboo fibers have a truncal part and feathered fibers peeled off from a surface of the truncal part.

2. The loudspeaker resin molding component according to claim 1, wherein the refined carbonized bamboo fibers are included at 3 weight % or more and 30 weight % or less.

3. The loudspeaker esin molding component according to claim 1, further comprising natural fibers.

4. The loudspeaker resin molding component according to claim 3, wherein the natural fibers are non-carbonized bamboo fibers.

5. The loudspeaker resin molding component according to claim 4, wherein a sum of the refined carbonized bamboo fibers and the non-carbonized bamboo fibers is 3 weight % or more and 60 weight % or less.

6. The loudspeaker resin molding component according to claim 4, wherein the non-carbonized bamboo fibers are refined to have a microfibril status having a freeness of 37 cc or less.

7. The loudspeaker resin molding component according to claim further comprising a bamboo powder.

8. The loudspeaker resin molding component according to claim 1, further comprising pulverized bamboo charcoal.

9. The loudspeaker resin molding component according to claim 1, further comprising compatibilizer consisting of a silane compound having a vinyl group.

10. The loudspeaker resin molding component according to claim 1, wherein the resin is polypropylene.

11. The loudspeaker resin molding component according to claim 1, wherein the resin is engineering plastic.

12. The loudspeaker resin molding component according to claim 1, wherein the resin is polylactic acid.

13. The loudspeaker resin molding component according to claim 1, comprising at least one of mica, talc, graphite, clay, calcium carbonate, and aramid fibers.

14. A loudspeaker comprising:

a magnetic circuit;

a frame connected to the magnetic circuit;

a diaphragm connected to the frame; and a voice coil connected to the diaphragm and partially placed within a range on which magnetic flux generated from the magnetic circuit acts, wherein at least one of the frame and the diaphragm is the loudspeaker resin molding component as defined in claim 1.

15. A loudspeaker comprising:

a magnetic circuit;

a frame connected to the magnetic circuit;

a diaphragm connected to the frame;

a voice coil connected to the diaphragm and partially placed within a range on which magnetic flux generated from the magnetic circuit acts; and a dust cap connected to the diaphragm, wherein the dust cap is the loudspeaker resin molding component as defined in claim 1.

16. An electronic device comprising:

an enclosure; and the loudspeaker as defined in claim 15, the loudspeaker being accommodated in the enclosure.

17. A mobile apparatus comprising:

a movable main body; and the loudspeaker as defined in claim 15, the loudspeaker being accommodated in the main body.

18. The loudspeaker resin molding component according to claim 1, wherein the refined carbonized bamboo fibers have been carbonized at a temperature of 500 ° C. or more.

19. A method for making a loudspeaker resin molding component, the method comprising steps of:

preparing carbonized bamboo fibers that are refined to have a microfibril status, have a freeness of 37 cc or less, and have a truncal part and feathered fibers peeled off from a surface of the truncal part;

mixing the refined carbonized bamboo fibers with a resin into a resin mixture; and molding the resin mixture.

* * * * *